United States Patent [19]

Hållberg

[11] Patent Number: 4,702,104

[45] Date of Patent: Oct. 27, 1987

[54] METHOD AND DEVICE FOR DETECTING WHEELS WITH DEFORMED TREADS IN RAILROAD VEHICLES

[76] Inventor: Karl R. S. Hållberg, Drottningvägen 35, S-181 32 Lidingö , Sweden

[21] Appl. No.: 855,490

[22] PCT Filed: Aug. 14, 1985

[86] PCT No.: PCT/SE85/00308

§ 371 Date: Apr. 14, 1986

§ 102(e) Date: Apr. 14, 1986

[87] PCT Pub. No.: WO86/01167

PCT Pub. Date: Feb. 27, 1986

[30] Foreign Application Priority Data

Aug. 14, 1984 [SE] Sweden ..... 8404092

[51] Int. Cl.[4] ..... G01M 17/00

[52] U.S. Cl. ..... 73/146; 246/169 R

[58] Field of Search ..... 73/146; 246/169 R, 169 S; 340/47, 52 R

[56] References Cited

U.S. PATENT DOCUMENTS 4,129,276 12/1978 Svet ..... 246/169 S

FOREIGN PATENT DOCUMENTS 734046 5/1980 U.S.S.R. .

*Primary Examiner*—Donald O. Woodiel

*Attorney, Agent, or Firm*—Ostrolenk, Faber, Gerb & Soffen

[57] ABSTRACT

A device for detecting deformed wheels in a railroad vehicle moving along a track. At least two wave motion sensors are positioned along said track. The wave motions in the rails created by the axial pressure of the vehicle are filtered out from two wave motion sensors spaced apart at a distance along the rails, and the vehicle speed is determined as well as the timing for each vehicle axle passage over at least one of the sensors. The frequency fractions of the vibration signal resulting from possible wheel deformations are filtered out from one or two of the sensors. An analyzer unit analyzes the type of wheel deformation while determining which one of the vehicle wheels is defective. A signal is fed to an alarm circuit upon indication from the analyzer unit that the signal or signals from the high frequency filtering deviate(s) from predetermined, acceptable formations.

10 Claims, 11 Drawing Figures

METHOD AND DEVICE FOR DETECTING WHEELS WITH DEFORMED TREADS IN RAILROAD VEHICLES

The invention relates to a device and to a method of detecting deformation in the wheels of a railroad vehicle moving along a track section, through the use of wave motion sensors positioned at the track which emit signals that are measured and the measured signals are used to determine a wheel deformation.

The treads of railroad vehicle wheels are exposed to a high degree of wear, and damages caused by faulty brakes and by traversing rail joints many times result in deformation of one or more wheels, i.e. the occurrence of so-called wheel flat spots. Such wheel flat spots will render the wheel imbalanced involving also the risk of rail breaking which could lead to derailment for example, causing damage of the rails and the rolling stock, personal injuries, expenses for rescue and salvage, insurance, franchise, operation stoppage and clearing. Moreover, the sooner the wheel defect is detected, the lower will be the repair and stoppage costs. It is also vitally important to detect loose wheel rims, defective axle bearings, bent wheel axles, loose stays, etc., sinoe there is otherwise the risk of such defects causing derailment of the vehicle.

Due to the urgent need of indicating wheel defects, there are numerous known systems of performing such indications which have, however, proved insufficient either by lacking the degree of reliability required for this purpose, or by demanding extensive arrangements such as specific rail constructions for measurement at certain control lengths, or the need of providing each single wheel or wheel axle of a rolling stock with individual detectors.

The object of the invention is to achieve a device which can be positioned at the existing track and which is provided with sensors for placement in or on both of the rails, said device serving to reliably detect the presence of defective wheels in a passing railroad vehicle. This purpose is fulfilled by the inventive device and the method detailed below.

The measuring device according to the invention is based on the fact that the wave motions occurring in the rails on the momentary deformation thereof caused by a passing railroad vehicle will give rise to gradual loads moving along the rails in response to the vehicle motion. Accordingly, the properties of the rails per se are actual factors utilized in the present invention.

If the railroad vehicle has a defective wheel, the load on the rails will vary in response to the rotation of the wheel. Waves of other frequencies will add to the waves created by the transient loads, and this formation with added frequencies will be more pronounced the more a wheel, bearing or wheel axle configuration deviates from normal.

Figure 1:
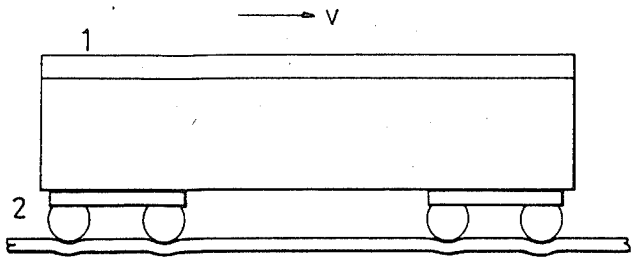
Figure 3:
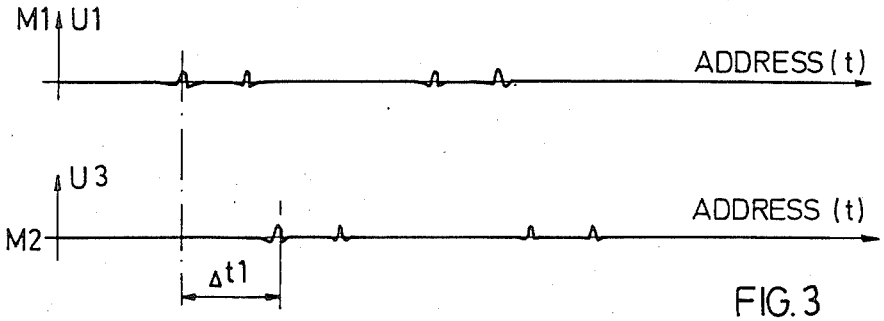
Figure 2:
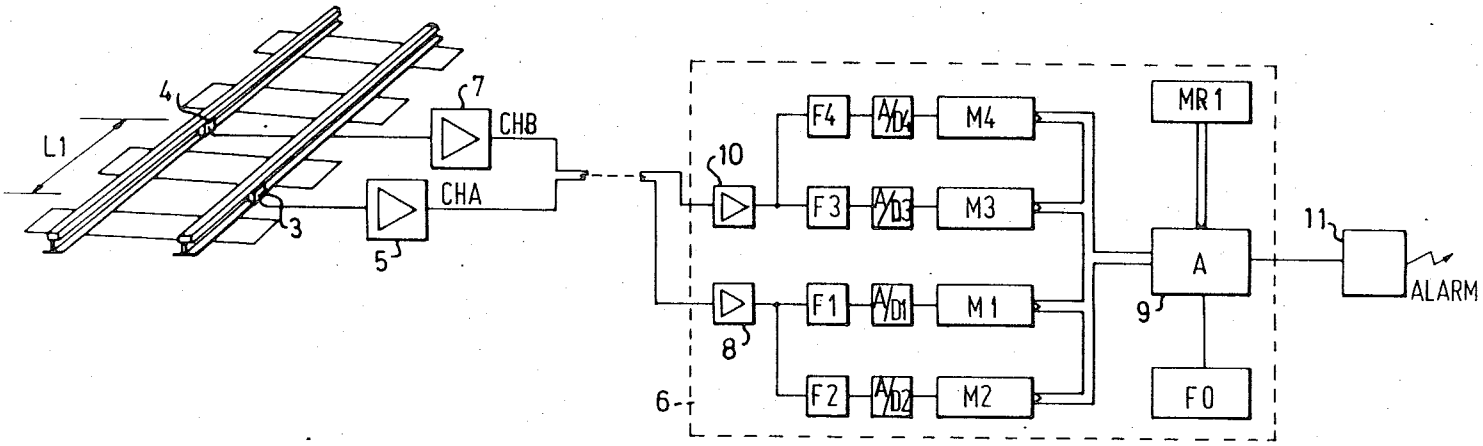
Figure 11:
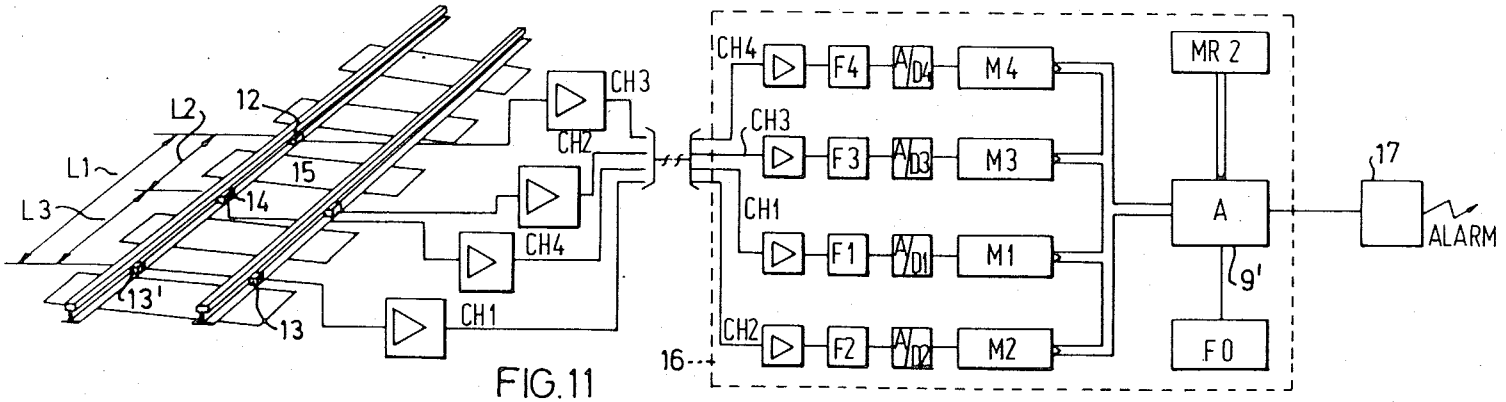

The invention will be described in more detail below with reference to the accompanying drawings, of which FIG. 1 shows a railroad vehicle travelling on a track and indicates the momentary deformation of the rails normally caused by the vehicle, FIG. 2 shows a first embodiment of the inventive device with sensors attached to the rails, FIGS. 3–10 are diagrammatic views of various curvatures, and FIG. 11 shows a second embodiment of the inventive device.

FIG. 1 illustrates a railroad vehicle 1 travelling on a rail 2 forming part of a track, and indicates to a larger scale the momentary deformation of the rail caused by the vehicle 1 and creating wave motions in the rails propagating along the rails at a certain rate. Vehicle speed is one of the factors determining the basic frequency of the wave motion, and to this basic frequency are added further components of frequency.

In the presence of one or more faulty wheels, momentary shock loads will normally occur giving rise to further high frequency overtones which add to the wave configuration already obtained.

According to an embodiment of the invention illustrated in FIG. 2, a wave motion sensor 3 or 4, respectively, is attached to each rail. There are various types of wave motion sensors available on the market such as those including a plurality of components individually tuned to be brought into resonance at different frequencies, a co-vibrating coil in a constant magnetic field as well as capacitor and piezoelectric type arrangements, or devices utilizing magnetostriction. All these types of vibration emitters, individually or in combination, can be used as wave motion sensors in the inventive device.

The sensors 3 and 4 are not placed directly opposing one another but are shown spaced apart a distance L1 along the rails. In this embodiment there are employed sensors capable of indicating both relatively low frequency and relatively high frequency processes. Suitable for this purpose are piezoresistive type sensors. The signal generated by the sensor 3 is transmitted, after pre-amplification in an amplifier 5, via a channel CHA to one input of a dual-input evaluation circuit 6 located at a distance from the sensors, whereas the signal from the sensor 4 is transmitted after pre-amplification in an amplifier 7 via a second channel CHB to the other input of the circuit 6.

In the circuit 6, the signal from the sensor 3 is once again amplified in an amplifier 8 before being fed to two parallel circuits each one comprising its individual filter F1 and F2, respectively, an analog/digital converter A/D1 and A/D2, respectively, and a memory M1 and M2, respectively, for the storage of measuring values sampled from passing trains. The sampling and control of the storage in various addresses in the memories is performed with the aid of a control and analyzer unit 9 which also analyzes the measuring results with the use of a reference memory MR1. The unit 9 is preferably a computer. The signal from the sensor 4, also in this case after amplification in an amplifier 10, is fed to two parallel circuits each one comprising a filter F3 and F4, respectively, an analog/digital converter A/D3 and A/D4, respectively, and a memory M3 and M4, respectively, controlled by the unit 9.

The units F1, A/D1 and M1 are of the same type as the units F3, A/D3 and M3, although F1 and F3, however, are filters for filtering out the signal obtained as a result of the axial pressure of a railroad vehicle travelling along the rails, thus constituting a band pass filter with pass bands around relatively low frequencies in the order of magnitude of 0.01–100 Hz. The signals obtained from these units are substantially equal but with a certain time lag $\Delta t1$. Examples of curve configurations stored in the memories M1 and M3 are given in FIG. 3. Because the distance L1 along the rails between the sensors 3 and 4 is predetermined and known, the vehicle speed v can be determined by the analyzer unit $$v = L1/\Delta t1 \quad (1)$$

wherein L1 is the distance between the sensors, and $\Delta t1$ is the time lag.

The units F2, A/D2 and M2 are of the same type as the units F4, A/D4 and M4; F2 and F4 being filters for filtering out the signal obtained as a result of wheel deformation, said filters having a pass band in the range of relatively high frequencies in the order of magnitude of 100–5000 Hz.

Figure 4:
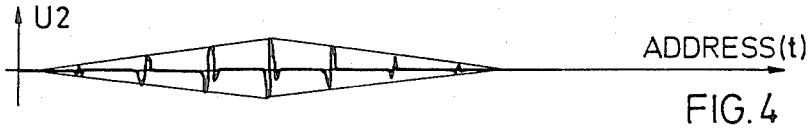
Figure 5:
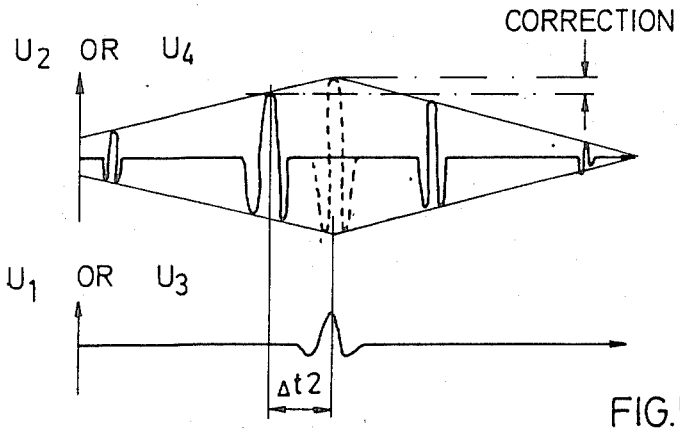

In principle, the signal stored in the memories M2 and M4 will have the same appearance as that shown in FIG. 4 if there is a flat spot on a wheel. As can be seen in the figure, there is obtained a periodic curve exhibiting dissimilarly damped deflections. The period is equal to the angular speed of the wheel, and the damping of the deflection is a function of the distance between the sensor and the striking point of the wheel flat spot on the rail. The analyzer unit 9 locates the maximum deflection from the wheel defect, compares it with the partial signal stored in the memory M1 or M3 for the corresponding channel CHA or CHB relating to axial load and lying closest in time to the maximum deflection, the axle carrying a defective wheel being identified in this manner. This is illustrated in FIG. 5.

The fact that the vehicle speed is known according to Equation (1) allows for the distance x between the most closely located sensor and the striking point of the wheel defect to be determined according to $$x = v/\Delta t2 \quad (2)$$

wherein $\Delta t2$ is the period of time between maximum deflection and the closest deflection as a factor of axial pressure (stored in the memory M1 or M3). Based on this value, the deflection caused by the wheel flat spot can be corrected by means of the damping constant for wave distribution obtaining thereby the value that would have been obtained if the striking point of the wheel dent should be located right above the sensor.

$$U2_{max} = U2_{deflection} * f(x)$$

$$U4_{max} = U4_{deflection} * f(x)$$

Figure 6:
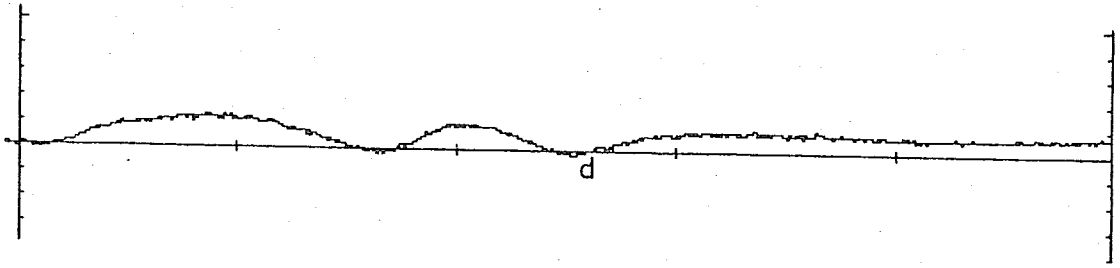
Figure 7:
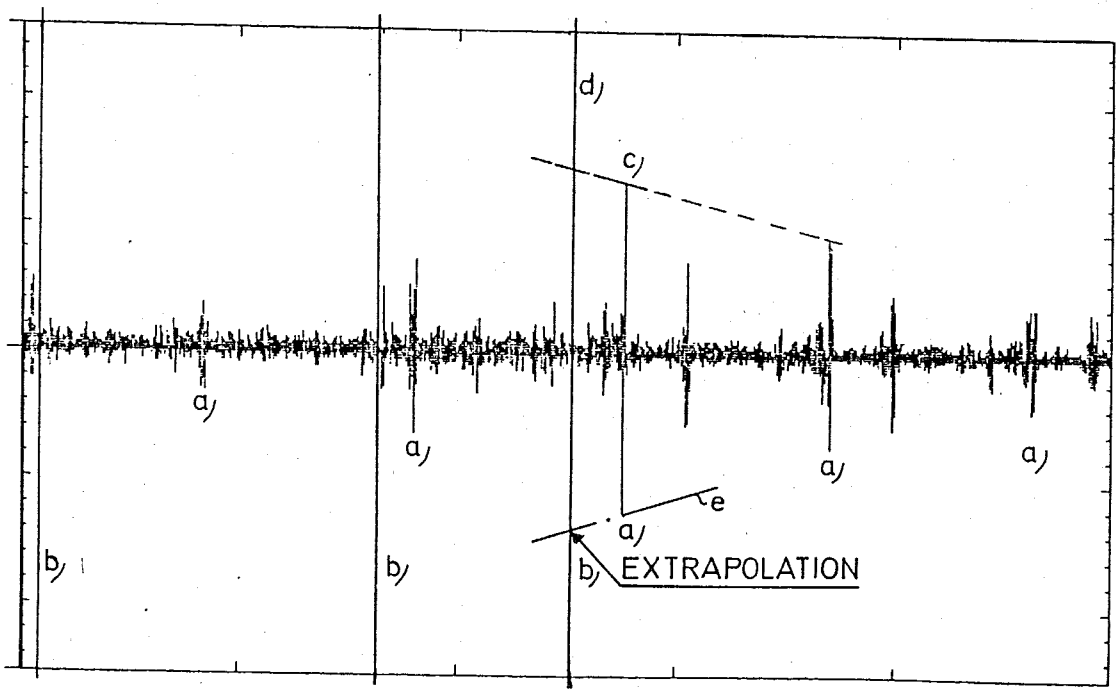

FIG. 6 illustrates an actually recorded curve of the rail deformation in time as a result of wheel axle passage, and FIG. 7 illustrates an actually recorded curve of the signal obtained as a result of wheel deformation.

a in FIG. 7 denotes the impulse received for each wheel revolution and propagating along the rail under different degrees of damping depending on the distance between the striking point and the wave motion sensor affixed to the rail. b denotes the wheel axle passage values derived from the curve in FIG. 6. c denotes a maximum value of an impulse registering wheel deformation on one of the hubs of the wheel axle denoted d in FIG. 6.

The dash-dotted line e denotes the extrapolation line, whereas the imaginary amplitude value of the signal from the sensor, if the deformation should strike the rail right above this sensor, is obtained at the point where the line e intersects a vertical line at d, as is shown in FIG. 7.

By thereafter comparing the extrapolated value with different levels of reference, it will be possible to vary the alarm signals as desired by the customer.

The wave motion originating from various types of defects can have different frequency characters. With a faultless wheel, the frequency function $X_p(f)$ is generated as an initiated frequency function. The rail has a certain transmission characteristic H(f), and the frequency function is then $$Y_p(f) = X_p(f) * H(f)$$

With a defective wheel, an initiated frequency function $X_s(f)$ is superimposed on $X_p(f)$.

In this way the measured frequency fraction will be approximately $$Y_{ps}(f) = [X_s(f) + X_p(f)] * H(f)$$

which can be expressed as $$Y_{ps}(f) = H(f) * X_s(f) + H(f) * X_p(f)$$

If the distance between sensor and signal source is short, H(f) will be close to 1, that is $$Y_{ps}(f) = X_s(f) + X_p(f) \text{ with interference}$$

$$Y_p(f) = X_p(f) \text{ without interference}$$

$$Y_{ps}(f) - Y_p(f) = X_s(f) + X_p(f) - X_p(f) = X_s(f)$$

Figure 8:
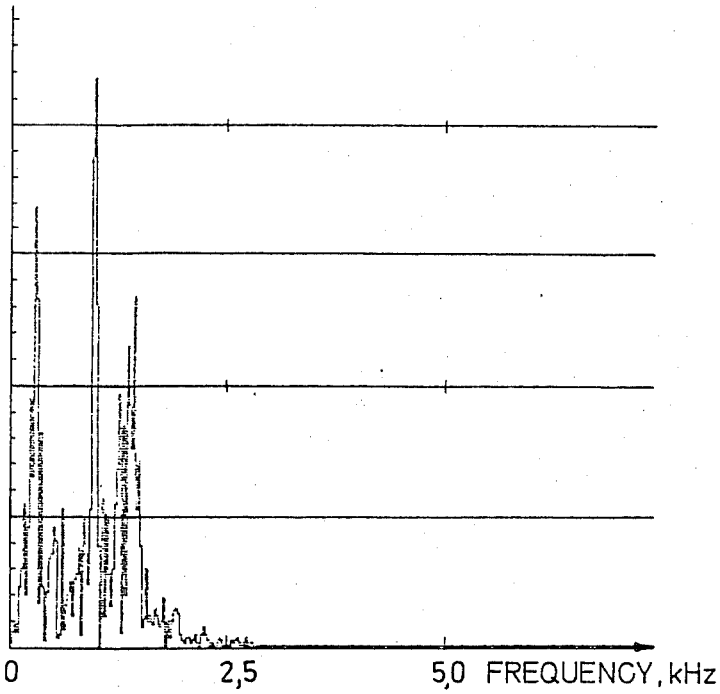
Figure 9:
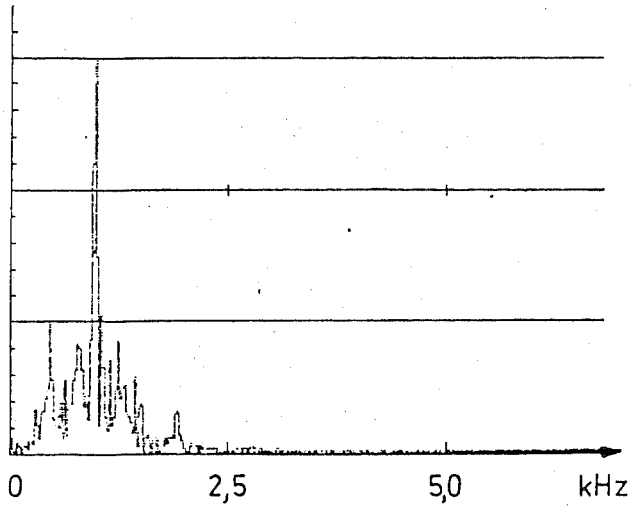
Figure 10:
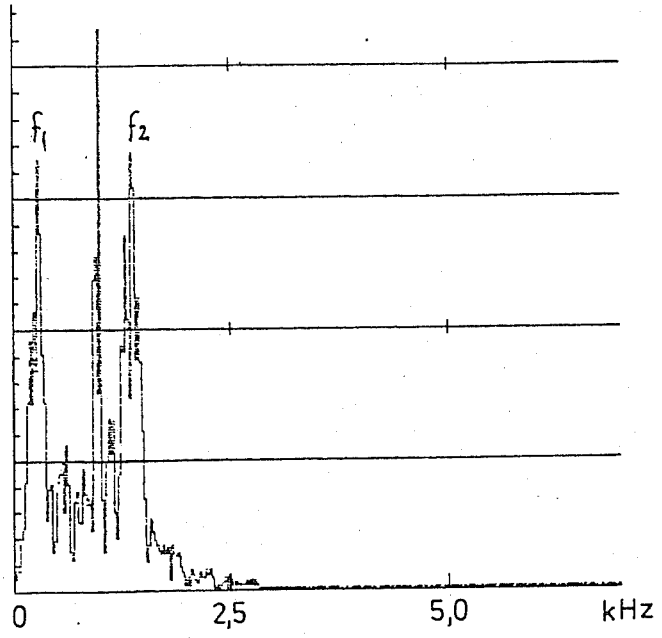

An indication on the presence of a wheel flat spot in the train can then be given by letting $Y_p(f)$ be a reference spectrum stored in a memory of the instrument, and by comparison thereof with the measured spectrum, the characteristic frequencies generated by a wheel flat spot can be recognized. This is shown in FIGS. 8–10. FIG. 8 shows the measured spectrum $Y_{ps}(f)$ from a wheel having a flat spot. Distinct peaks can be clearly seen at three frequencies. FIG. 9 shows a reference spectrum $Y_p(f)$ from a wheel with no flat spot. The reference spectrum exhibits a peak at the middle frequency of those three shown in FIG. 8. FIG. 10 illustrates the frequency spectrum obtained if the spectrum of FIG. 9 is subtracted from that of FIG. 8, and constitutes the spectrum $Y_s(f)$ from a wheel flat spot. The two lateral peaks at frequencies f1 and f2 then appear still more distinctly. Furthermore, there is also the middle frequency heavily marked. The reason is that a defective wheel will run much more heavily and bumpy on the rails; such a wheel as a whole giving a more powerful indication than a wheel with no flat spot, i.e. in comparison with a wheel with a spectrum of reference character. By determining the frequency spectrum in the area of each wheel axle passage, the amplitude $Y_s(f1)$ and $Y_s(f2)$ will be dependent on the size of the wheel flat spot and the angular speed of the wheel. Varying types of alarm can be provided in dependence of amplitude.

FIG. 11 illustrates a second embodiment of the inventive device. Piezoresistive sensors are relatively expensive. Since low frequency and high frequency vibration processes in the rails are to be individually detected, also sensors adapted for separate indication of those different frequency ranges should preferably be used. In order to indicate wheel axle passages, sensors 12, 13 of the strain gauge type can be utilized. Such sensors are shown in the figure spaced apart a distance L1 along the rails, each one on its own rail. This is no prerequisite, however, and for this reason 13' denotes that the sensor 13 could just as well be placed on the same rail as the sensor 12. For indicating the wave motion of higher frequency generated by a possible wheel deformation, sensors 14, 15 of piezoelectric type could be used to advantage. Such sensors are shown in FIG. 11 each placed on its own rail opposite to each other and at a distance L2 along the rail from the sensor 12 and a distance L3 along the rail from the sensor 13 (13'). These positions are in no way crucial but the sensors 14, 15 can be arbitrarily placed and preferably somewhere between the sensors 12 and 13. The only condition to be fulfilled is that the time lag between the respective signals obtained from the sensors be easily determined with the guidance of the speed of a vehicle rolling on the track. The position (not shown) of the sensors affording the simplest calculation, however, is opposite any one of the two sensors 12 or 13.

After an initial amplification via their respective channel CH1–CH4, the signals emitted from the sensors 12–15 are each fed to its own input on an analyzer unit 16 and are fed therein, after being further amplified, each through its own circuit comprising in series connection a filter, an A/D converter and a memory. However, it is to be noted that the filters F1 to F4 are only needed if the sensors themselves do not inherently provide the band pass action. Therefore, if the sensors 12 and 13 are of the strain gauge type, then the filters F2 and F4 are not needed. These circuits correspond entirely to the same type of circuits described above for the analyzer unit 6 and referred to in FIG. 2, and therefore the same reference numerals have been used. The analyzer unit 9' performs the same types of analysis as those described for the analyzer unit 9 shown in FIG. 2 with the distinction, however, that on calculation there be also taken due regard to the various mutual placements of the sensors 12–15 along the track.

Many modifications are conceivable within the scope of the invention. The two embodiments illustrate sensors disposed at both rails of a track, which is also the most normal method for detecting deformations possibly occurring on wheels rolling on both of the rails. There may, however, be occasions when the sole intention is to detect deformations on wheels running on one rail only. It is then easily understood that the principles of the present invention are applicable for such cases as well; all sensors then of course being placed on one and the same rail. Other locations of the sensors along the rails than those shown in the figures are also feasible, and the analytic circuits can have a more complex design deviating to some extent from the principle constructions illustrated in the figures.

I claim:

1. Method of detecting deformed wheels in railroad vehicles moving along a track section where at least two wave motion sensors (3,4;12–15) are positioned at the track while being in mechanical rail contact, the signals from the wave motion sensors being fed to an analytic circuit whereby an output signal with relatively low frequency is received from two of the wave motion sensors (3,4;12,13) spaced apart a predetermined distance L1, and an output signal with relatively high frequency is received from at least one of the wave motion sensors (3,4;14,15), characterized in that a time lag is indicated between substantially uniform signals received from the wave motion sensors (3,4;12,13) emitting an output signal with relatively low frequency, the vehicle speed being determined with the guidance of the distance L1 and the preset time lag; that the points of time for wheel passage are indicated in each one of the wave motion sensors (3,4;14,15) emitting an output signal with relatively high frequency whereby this timing, unless the wave motion sensor for relatively low frequency and the wave motion sensor for relatively high frequency are one and the same or are situated directly at the same position, is performed with the guidance of vehicle speed and the distance along the rail to one of the wave motion sensors (3,4;12,13) emitting an output signal with relatively low frequency; that the curvatures of the signal from each one of the wave motion sensors (3,4;14,15) emitting an output signal with relatively high frequency are individually analyzed and digitally processed; that the processed output signals from the wave motion sensors (3,4;14,15) emitting an output signal with relatively high frequency are individually compared with several signal levels permanently stored in a digital memory (MR1;MR2), said levels being obtained from reference measurements on wheels having known characteristics such as wheels without deformations and with different types of deformation, and e.g. on recordings of railroad vehicles travelling at various speeds; and that the presence of wheel deformation is analyzed with the guidance of this comparison.

2. Method according to claim 1, characterized in that on detection of the presence of wheel deformation, the railroad vehicle wheel being defective is determined by counting the number of wheel passages across any one of the wave motion sensors up to the passage lying closest to the time zone in the signal from the wave motion sensor emitting an output signal with relatively high frequency where the presence of wheel deformation has been detected.

3. Method according to claim 1, characterized in that when an output signal is obtained from any one of the wave motion sensors for relatively high frequency indicating wheel deformation, the striking point of a wheel deformation on the rail is determined by analyzing the curvature from the wave motion sensor in question while performing extrapolation of the indicated signal fractions to the position in time estimated for the event of the wheel deformation striking point being located right above the wave motion sensor in question with the guidance of vehicle speed while considering the attenuation in the rail of wave motions caused by the depression of the vehicle on the rail.

4. Method according to claim 1, characterized in that vibration sensors (3,4;14,15) for relatively high frequency are placed on the track, each sensor being affixed to its individual rail.

5. Device for detecting deformed wheels in railroad vehicles moving along a track provided with at least two wave motion sensors (3,4;12–15) being located at the track while being in mechanical rail contact where the signals are fed to an analytic circuit (6;16), an output signal with relatively low frequency being arranged to be obtained from two of the wave motion sensors (3,4;12,13) which are spaced apart a predetermined distance L1, and an output signal with relatively high frequency being arranged to be obtained from at least one of the wave motion sensors (3,4;14,15), characterized in that the analytic circuit (6;16) determines the time lag between substantially uniform signals obtained from the wave motion sensors (3,4;12,13) emitting an output signal with relatively low frequency and determines the vehicle speed with the guidance of the distance L1 and the preset time lag; that the analytic circuit determines the timing of wheel passage in each one of the wave motion sensors (3,4;14,15) emitting an output signal with relatively high frequency; that the curvatures of the signal from each one of the wave motion sensors (3,4;14,15) emitting an output signal with relatively high frequency are arranged to be individually analyzed and digitally processed by the analytic circuit; that the analytic circuit compares separately the processed signals from the wave motion sensors (3,4;14,15) emitting an output signal with relatively high frequency with several signal levels stored in a digital memory (MR1;MR2), said levels being obtained on reference measurements of wheels having known characteristics such as wheels without deformation and with various types of deformation, and e.g. on recordings of railroad vehicles travelling at different speeds; and that the analytic circuit analyzes wheel deformation with the aid of said comparison.

6. Device according to claim 5, characterized in that the analyzer unit (6;16), with the guidance of the estimated vehicle speed and the output signal from each one of the wave motion sensors (3,4;14,15) is arranged to separately determine the distance between the respective sensor and the wheel deformation striking point on the rail by analyzing the signal obtained; and that the analyzer unit is also arranged to extrapolate the output signal from the sensor with the aid of the estimated distance and with the use of a damping function for the rail, imparting thereby to the output signal the appearance it should have obtained if the deformation had hit the rail right above the sensor in question.

7. Device according to claim 6, characterized in that during fixed time intervals at each outburst of signals, each filtered signal with the relatively higher frequencies is arranged to be analyzed by the analyzer unit (6;16) with regard to its frequency contents; and that the analyzer unit, possibly after additional signal processing, is arranged to compare the analyzed frequency contents with one or more reference formations stored in the reference memory and obtained upon recording of signals from wheels without deformation, and to emit a signal to an alarm circuit (11;17) when the analyzed frequency formations present heavily marked fractions of frequency outside said reference frequency formations.

8. Device according to claim 5, characterized in that on the analysis of a wheel deformation, the analytic circuit is arranged to locate the defective wheels in a railroad vehicle by counting the number of wheel passages above any one of the wave motion sensors and up to the passage lying closest to the time zone of the output signal from the wave motion sensor emitting an output signal with relatively high frequency where the presence of wheel deformation has been detected.

9. Device according to claim 5, characterized in that all wave motion sensors are of the piezoresistive type.

10. Device according to claim 5, characterized in that separate wave motion sensors are arranged for indicating an output signal with relatively low frequency, such as strain gauge type sensors for example, and of an output signal with relatively high frequency, such as vibration sensors of piezoelectric type for example.

* * * * *